United States Patent [19]

Blasio

[11] 4,257,523

[45] Mar. 24, 1981

[54] DEVICE FOR STORING, TRANSPORTING, LIFTING AND UTILIZING WIRE ROD

[75] Inventor: Pietro Blasio, Florence, Italy

[73] Assignee: Italrame S.p.A., Italy

[21] Appl. No.: 33,948

[22] Filed: Apr. 27, 1979

[30] Foreign Application Priority Data

Sep. 29, 1978 [IT] Italy ..... 69242 A/78

[51] Int. Cl.[3] ..... B65D 85/04; B65D 19/29; B65D 19/44

[52] U.S. Cl. ..... 206/303; 206/386; 206/511; 108/55.3; 211/49 R

[58] Field of Search ..... 206/596, 303, 511, 512, 206/509, 510; 211/13, 49 R, 59.1; 108/53.1, 55.3, 56.3

[56] References Cited

U.S. PATENT DOCUMENTS

| | | | |
|---|---|---|---|
| 2,828,023 | 3/1958 | Berra et al. | 206/511 |
| 2,916,152 | 12/1959 | Dull | 108/55.3 |
| 3,021,010 | 2/1962 | McMasters | 108/55.3 |
| 3,127,018 | 3/1964 | McMasters | 108/55.3 |

*Primary Examiner*—William T. Dixson, Jr.
*Attorney, Agent, or Firm*—Gifford, VanOphem, Sheridan & Sprinkle

[57] ABSTRACT

A device for storing, transporting and utilizing wire rod, on which a ring-shaped wire rod coil (4) is prepared, is described. The main feature of this device is that it comprises substantially two frames (1, 21) rigidly connected together, the first (1) of which constitutes the spool for winding said wire rod coil, and the second (21) of which constitutes an axial support for said coil, said first frame being provided with support means (9) to enable the first frame of another device to be rested on it.

8 Claims, 7 Drawing Figures

DEVICE FOR STORING, TRANSPORTING, LIFTING AND UTILIZING WIRE ROD

BACKGROUND OF THE INVENTION

This invention relates to a device which enables wire rod to be wound, stored, transported and utilized.

Usually, these operations are notably carried out by winding the wire rod as a coil on a rigid support in the form of a spool, which may be flanged at its ends, and transporting, stacking, lifting and unwinding the wound coil with difficulty using further auxiliary equipment, which is sometimes uncommon.

It is normally transported either by lift trucks which in place of forks comprise a vertically mobile nose which is inserted into the coil spool, or by placing a cable sling around the coil, then lifting it and moving it with a crane truck.

Stacking is normally difficult because either the coil spools are unable to properly support the weight of an overlying coil, or the spools do not provide a suitable support surface for the overlying spool, and in any case the lifting necessary for the stacking operation must be carried out by slinging using a crane. In effect, it is preferred at this point to store the coils without stacking them, and large stores are therefore needed.

The coil normally has to be lifted using a crane and slinging, and a normal fork lift truck can only be used if the coil is previously placed in a container.

Finally, the wire rod is unwound using a mechanism by which the spool is rotated.

The aforegoing underlines the difficulty of the described operations using present-day methods of handling wire rod coils, both in terms of the equipment to be used and in terms of the time employed.

SUMMARY OF THE INVENTION

The object of the device according to the invention is to enable wire rod to be wound, transported, stacked, lifted and unwound using a single device designed for all these operations.

This device enables the aforesaid operations to be carried out with ease, using only the most common transportation and lifting means.

As will be apparent hereinafter, with the device according to the invention only a normal fork lift truck need be used for moving the wire rod coil, and the stacking presents no difficulty as several coils can be stacked one above the other and a coil can be removed from the stack, again using a normal fork lift truck.

The wire rod coil is lifted by means of a simple crane without the need for any slinging, and the wire rod is easily unwound without the need to rotate the coil.

The invention provides a device for storing, transporting and using wire rod, on which a ring-shaped wire rod coil is prepared, comprising substantially two frames rigidly connected together, the first of which constitutes the spool for winding said wire rod coil, and the second of which constitutes an axial support for said coil, said first frame being provided with support means to enable the first frame of another device to be rested on it.

BRIEF DESCRIPTION OF THE DRAWINGS

The present invention will be more apparent from the description of one embodiment given hereinafter by way of example, with reference to the accompanying drawings in which.

DETAILED DESCRIPTION OF THE INVENTION

Figure 1:
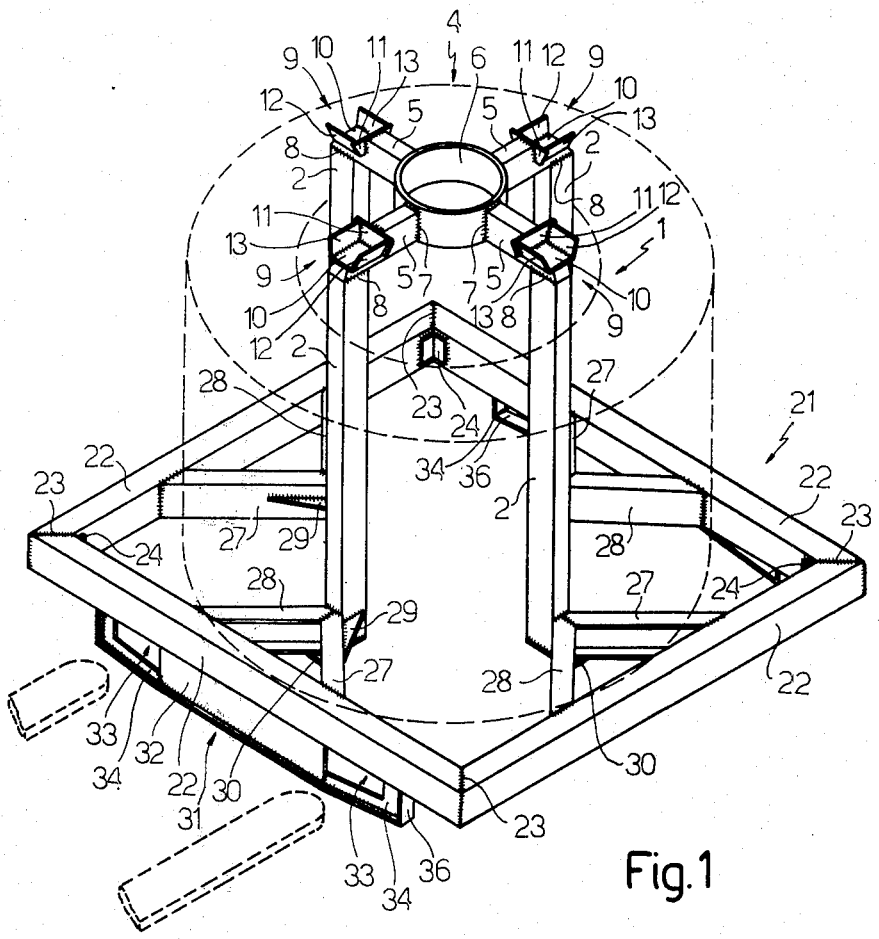
FIG. 1 is a perspective view of the device.
Figure 2:
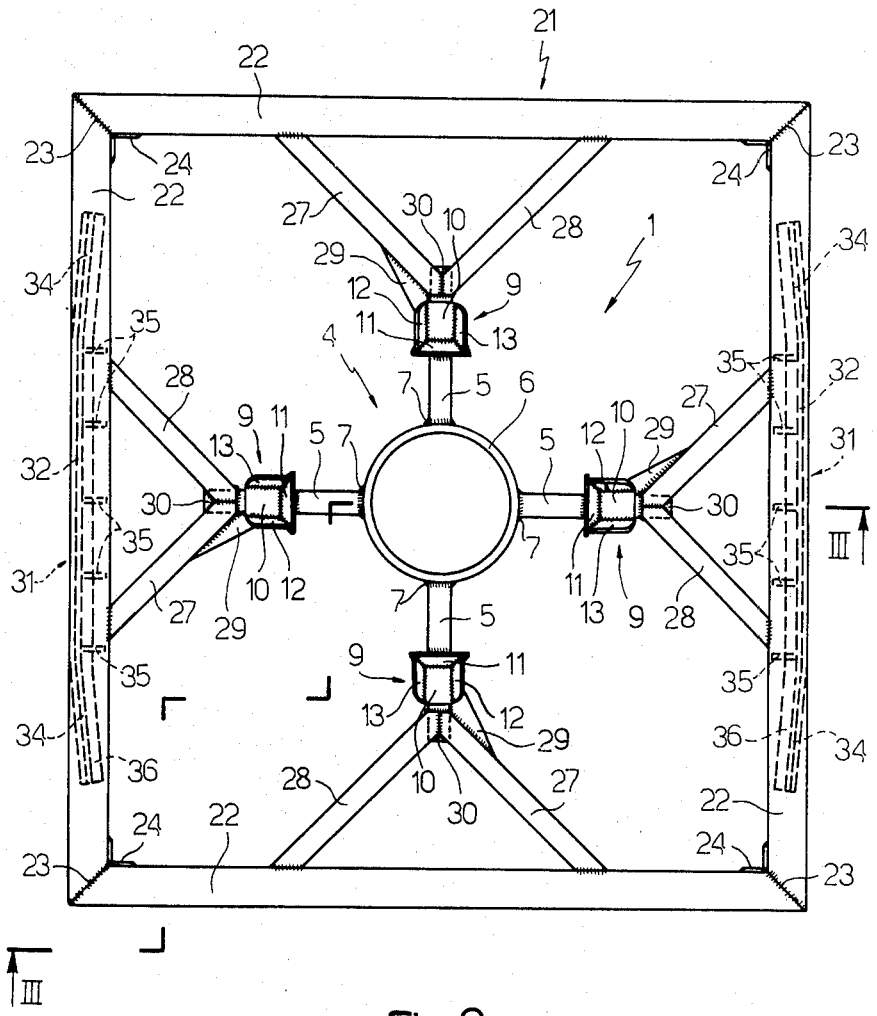
FIG. 2 is a plan view of the device.
Figure 3:
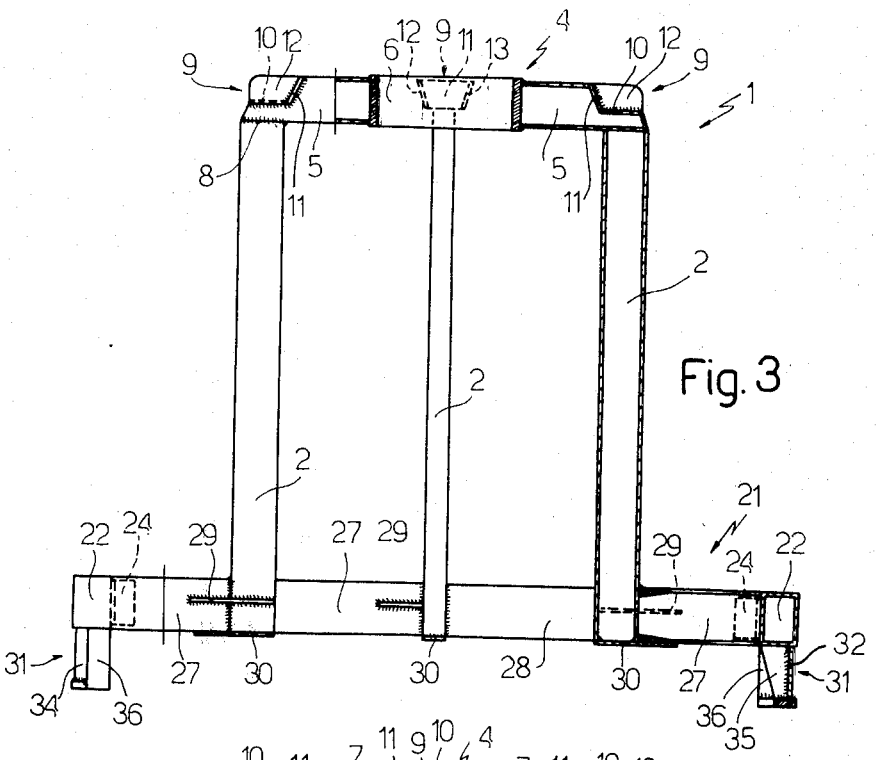
FIG. 3 is a partly sectional side view of the device.
Figure 4:
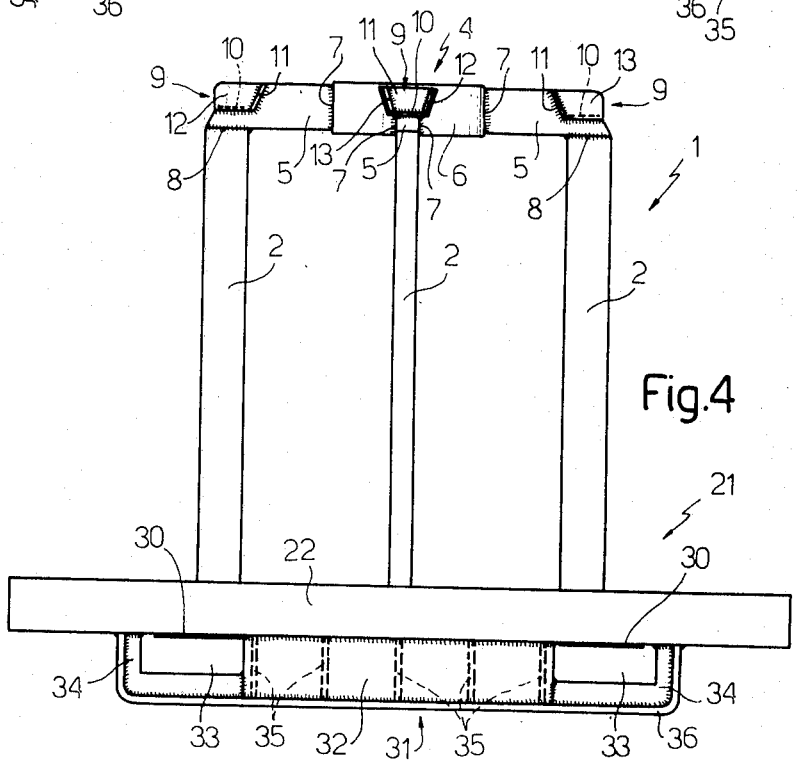
FIG. 4 is a further side view of the device.

With reference to FIGS. 1, 2, 3 and 4, the device according to the invention comprises a first frame 1, formed from four similar vertical uprights 2 spaced equidistantly apart, their ends lying substantially in a horizontal plane. They are constituted by tubes of rectangular section, and the major axis of this section is positioned in a radial direction.

The uprights 2 are connected at their upper end to a cross 4, formed from four similar radial arms 5 and a ring 6.

The arms 5 are constituted by tubes of rectangular section, and the major axis of this section is positioned vertically. An upper part of the section of these arms is missing at those ends farthest from the cross 4. As can be seen in the sectional view of FIG. 3, this section is slightly inclined towards the interior of the cross 4 at the said end.

The ring 6 is constituted by a piece of tube of circular section, its axis being equidistant from the uprights 2. The end of the arms 5 on the inside of the cross 4 is connected to the ring 6 by a weld 7, and the other end, on the outside of the cross 4, is connected to the uprights 2 by a weld 8.

A support seat 9 is located at that end of the arms 5 farthest from the cross 4, where the upper part of the section of the arms 5 is missing. Each of the seats 9 is constituted by four plates 10, 11, 12, 13. The plate 10 is rectangular and lies in a horizontal plane. The plate 13 is trapezium shaped and lies in a plane inclined by slightly more than 90° to the plane of the plate 10, to which it is joined by welding. The plates 11 and 12 are similar and of approximately rectangular shape, and are slightly inclined to the plate 10. They are joined to the plates 13 and 10 to form support seats 9, each of which comprises a base wall and three side walls.

The device according to the invention comprises a second frame 21 formed from four similar cross members 22 lying in a horizontal plane. Each of these is constituted by a tube of rectangular section, the major axis of the section lying vertically. They have their ends cut conveniently at 45° and are joined together in a square, by a weld 23 at said ends. A strengthening bracket 24 is welded on the inside of each right angle formed by the cross members.

Pairs of struts 27, 28 connect the cross members 22 to the said uprights 2 of the first frame. These struts are conveniently in the form of channel sections, and lie in the same horizontal plane as the cross members 22. The struts lie at an angle of 90° to each other, and their vertex is joined to the uprights 2 by welding, their other two ends being welded to regions on the inner lateral faces of the struts 22, symmetrically about the center line of the struts. Conveniently, a triangular strengthening plate 29 is welded to the uprights 2 and struts 27 in the horizontal central plane of the struts.

A further horizontal strengthening plate 30 is welded to the lower end of the uprights 2 and to a lower part of the vertex of the pairs of struts 27, 28.

Guides 31 for forks are welded to two opposing cross members 22. The weld is made between the lower face of each said strut and the upper side of each guide 31. The guides 31 comprise three parts, namely a central flat part 32 in the shape of a rectangle with its major axis horizontal and stiffened by rectangular stiffening plates 35 (FIGS. 2–4) welded to the central part 32 so that they are equidistant, and two rectangular lateral parts 34 disposed symmetrically about the central part 32 and with their major axis horizontal. They are inclined towards the interior of the frame 21 by a small angle, and comprise rectangular bores 33. The parts 32 and 34 are joined together by a weld along the contact edge.

A sheet metal stiffening strip 36 is welded along three free edges of each guide 31, orthogonally to the plane of the guide, and is also welded to the ends of the cross member 22.

Figure 5:
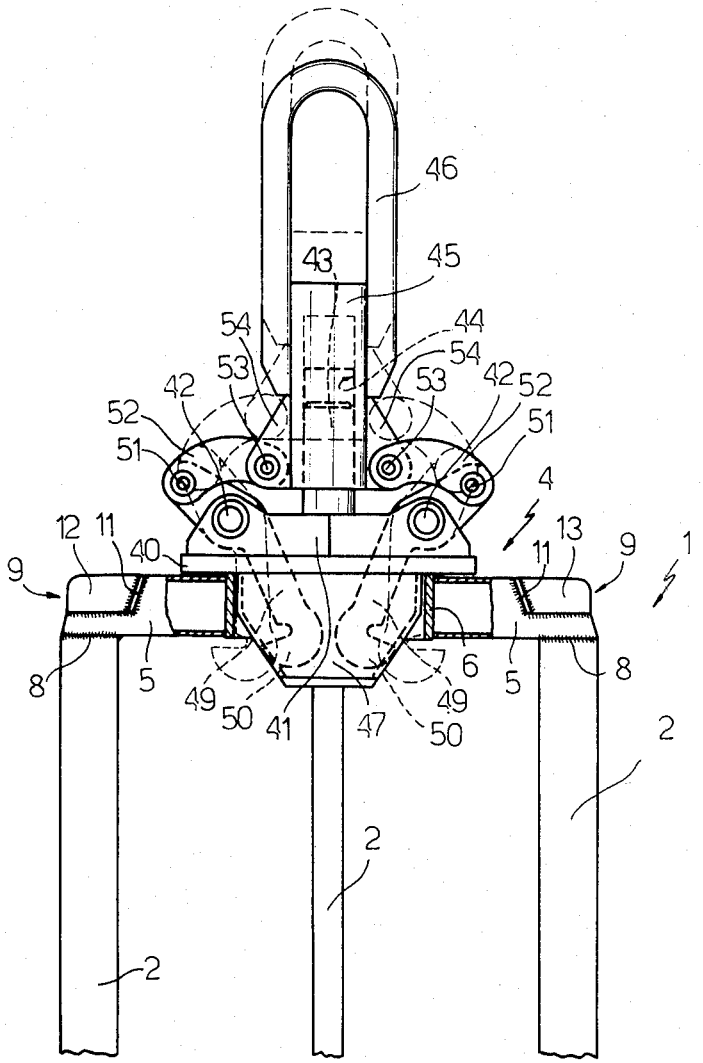
FIG. 5 shows a hooking mechanism forming part of the device.

The device according to the invention also comprises a hooking mechanism for the first frame 1, illustrated in FIG. 5.

This mechanism comprises a horizontal plate 40, conveniently of circular shape, its diameter being greater than the outer diameter of the ring 6. The plate 40 comprises three nearly radial grooves (not shown). On the upper surface of the plate there are connection plates 41 provided with bores in which pins 42 are inserted, the assembly comprising the plate 40 and connection plates 41 being connected to a pin 43 coaxial to said plate and slidable in an axial bore 44 formed at the lower end of a cylindrical block 45, which at its other end comprises a transverse through-bore (not shown in the Figure) with which a ring 46 for hooking by a crane hook cooperates.

At the bottom of the plate 40 there is a cap 47 open to the three said nearly radial grooves in the plate 40. It is cylindrical in the vicinity of the plate, and of cone frustum shape towards the lower end, with a diameter slightly smaller than the internal diameter of the ring 6.

Three flat mobile connection plates 49 are hinged by the pins 42 to the fixed connection plates 41. Each of them comprises a lower arm and an upper arm on opposite sides of the pin 42. The lower arm is shaped at its end 50 in the form of a hook, and the upper arm comprises a bore 51 and is hinged to the lower arm of another connection plate 52.

Three ribs 54 fixed to the cylindrical block 45 in a plane axial to the plate 40 comprise bores 53, in each of which is pivoted one end of the connection plate 52.

When the described hooking mechanism is inserted into the ring 6 of the cross 4, the hook-shaped ends of the lower arms 50 of the connection plates 49 cooperate with the lower edge of the ring.

Figure 6:
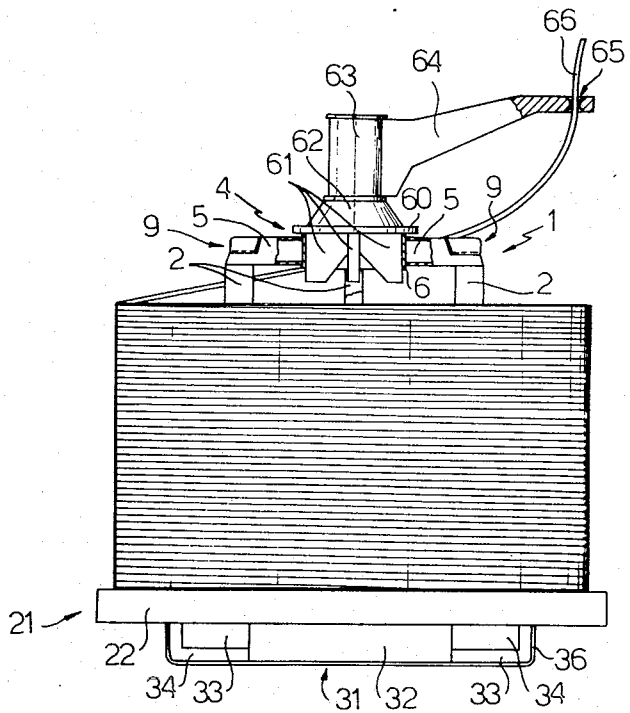
FIG. 6 shows a mechanism for lifting the wire rod.

The device according to the invention also comprises a mechanism for unwinding the wire rod, illustrated in FIG. 6.

On its lower face, a circular plate 60 comprises four radial ribs 61 having a radial dimension slightly less than the inner diameter of the ring 6 of the cross 4. This plate has a diameter exceeding the diameter of said ring 6.

A vertical pin coaxial to the plate 60 (not shown in the figure) is supported by said plate 60 by means of a connection portion 62. A bush 63 coaxial to said pin can rotate about it, and carries an arm 64 connected at one end to the bush 63, and provided at its other end with a bore 65 of vertical axis, having a diameter greater than the diameter of the wire rod 66 wound on the frame 1. When this mechanism is inserted into the ring 6 of the cross 4, the wire rod 66 can be passed through the bore 65.

The operation of the device according to the invention is as follows.

With reference to FIGS. 1 to 7, the wire rod 66 can be wound as a coil about the frame 1, to which the other frame 21 offers an axial support.

Figure 7:
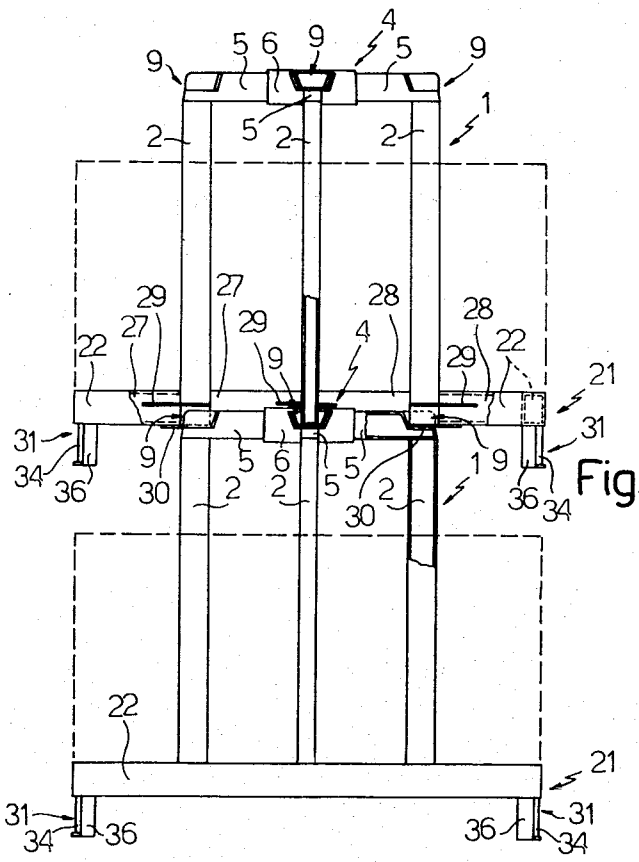
FIG. 7 is a view of two stacked devices.

The assembly comprising the two frames 1 and 21 can be stacked as shown in FIG. 7, as the uprights 2 of the upper frame 1 can be supported by the seats 9 of the lower frame 1. The assembly comprising the two frames 1 and 21 can be easily transported, as the forks of a fork lift truck can be inserted into the bores 33 in the guides 31. The assembly can also be easily lifted by the described hooking mechanism in the following manner. With reference to FIG. 5, the cap 47 is firstly inserted into the ring 6 of the cross 4 of the frame 1. This is possible if no traction force acts on the ring 46, because in such a case the hooks at the lower ends of the connection plates 50 can be moved towards the axis of the mechanism and thus be inserted into the bore 6. This is because if the ring 46 is not pulled, the cylindrical block 45 can move downwards guided by the pin 43, and the ribs 54 also move downwards. The connection plates 52 thus move into a substantially horizontal position and allow the connection plates 49 to rotate about the pins 42 and to incline to the vertical, so that the ends 50 move towards the axis of the mechanism.

When the ring 46 is pulled, the block 45 moves upwards guided by the pin 43, and the ribs 54 move with it. The connection plates 53 move towards the vertical position (shown in FIG. 5 by a dashed line) and cause the connection plates 49 to rotate about the pins 42. This rotation causes the ends 50 of the connection plates 49 to cooperate, by way of the hook with which they are provided, with the lower edge of the ring 6 in the cross 4 of the frame 1, thereby allowing the device to be lifted.

The wire rod can be unwound easily, by using the previously described unwinding mechanism. With reference to FIG. 6, the ribs 61 of the plate 60 are inserted into the ring 6 in the cross 4 of the frame 1, and one end of the wire rod 66 is passed through the bore 65 in the arm 64.

As this arm can rotate about the axis of the plate 60, and as this now coincides with the axis of the frame 1, the wire rod can be easily unwound.

The advantages of the device according to the invention are now apparent, in relation to winding the wire rod, transporting the device with the wound wire rod, stacking the device, lifting the device by the described hooking mechanism, and unwinding the wire rod by the unwinding device of FIG. 6.

Modifications can be made to the described embodiment of the invention, without leaving the scope of the inventive idea.

What we claim is:

1. A device for storing, transporting and utilizing wire rod formed into a ring shaped wired rod coil, said device comprising:

a first frame around which said wire rod is formed into a coil, said first frame having an upper and lower end, said first frame having support means at its upper end for engaging and supporting the lower end of a further first frame whereby said first frames can be stacked upon each other, a second frame secured to and extending laterally outwardly from the lower end of said first frame, said second frame forming a platform which provides axial support for said wire rod coil.

2. The invention as defined in claim 1, wherein said first frame comprises at least four vertical uprights connected rigidly to said second frame, said support means comprising a plurality of support seats, each of which is provided on the upper end of one of said uprights and wherein each seat forms a support for the lower end of an upright of another device.

3. The invention as defined in claim 2, wherein each of said support seats of the support means comprises a support wall, two side walls and a rear wall inclined to said support wall, said rear wall being joined substantially to the end of one of said arms of the cross.

4. The invention as defined in claim 1, wherein said second frame comprises substantially four cross members disposed in a rectangular configuration, each of said cross members being rigidly joined to the lower end of one of said uprights of the first frame.

5. The invention as defined in claim 4, wherein each of said cross members is joined to the corresponding upright by a pair of connection members disposed in the same plane as the cross members of said second frame.

6. The invention as defined in claim 5, wherein each pair of connection members is constituted by a pair of struts disposed substantially as a V, a first end of each of said struts being joined to said lower end of an upright, and the second end to one of said cross members of the second frame.

7. The invention as defined in claim 1, wherein said second frame is provided with means for gripping the device by the fork of a fork lift truck.

8. The invention as defined in claim 7, wherein said gripping means comprise a pair of plates, each of which is fixed below one of said cross members of the second frame and is provided with a pair of holes for said fork.

* * * * *